US006328606B1

(12) United States Patent
Davis et al.

(10) Patent No.: US 6,328,606 B1
(45) Date of Patent: Dec. 11, 2001

(54) HIGH DENSITY ELECTRICAL CONNECTOR SYSTEM

(75) Inventors: Wayne Samuel Davis, Harrisburg; Robert Neil Whiteman, Jr., Middletown, both of PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/570,212

(22) Filed: May 12, 2000

(51) Int. Cl.[7] ..... H01R 24/00
(52) U.S. Cl. ..... 439/660; 439/857
(58) Field of Search ..... 439/660, 857, 439/74, 83, 31

(56) References Cited

U.S. PATENT DOCUMENTS 4,632,475 * 12/1986 Tomita .
5,727,961 * 3/1998 Landis et al. ..... 439/287
6,142,811 * 11/2000 Lin ..... 439/342

* cited by examiner

*Primary Examiner*—Khiem Nguyen

(57) ABSTRACT

An electrical connector system (20) includes first and second complementary connectors (22, 60), each connector having a housing (24, 62) with a mating face (26, 64), and a plurality of terminals (48, 86), each disposed in a respective terminal receiving passageway (40, 72). Each first connector terminal receiving passageway (40) includes a blade receiving slot (42) extending from the mating face (26) and through a portion of an adjacent housing side wall (38). Each first connector terminal (48) has a first connecting portion (50) adapted to receive a blade connecting portion (96) therebetween upon being mated thereto. Each second connector terminal 86 has a first connecting portion 96 defined by a blade extending into a shrouded mating cavity (66) along side walls thereof such that upon mating the connectors (20, 60) each blade connecting portion (96) is received into a corresponding blade receiving slot (42) of the first connector (20) and is electrically engaged to the first connector terminal (48) therein.

24 Claims, 15 Drawing Sheets

HIGH DENSITY ELECTRICAL CONNECTOR SYSTEM

FIELD OF THE INVENTION

The present invention is directed to electrical connectors and more particularly to high density electrical connectors.

BACKGROUND OF THE INVENTION

As electronic devices become smaller and smaller, the electronics industry has an increasing need for high density, compact electrical connectors, that is, connectors having a plurality of closely spaced terminals in a small package. Such connectors are particularly useful in interconnecting circuit boards to one another and in interconnecting cables to circuit boards. It is desirable that the connectors occupy a minimum amount of space on the circuit board while providing a stable interconnection. In cable to board connections, it is particularly desirable to minimize any rocking of the connector on the board to assure that electrical continuity is maintained. It is also desirable to provide polarization for the connectors. When connecting multiple cables of the same size to the same board, it is further desirable to provide keying for the mating connectors to assure the cables are connected to the desired connector on the board.

Cable to board and board to board connectors typically have used pin and socket terminals or cantilevered beams, leaf or ribbon-like contact or the like. As the connectors become smaller and more dense, however, the centerline spacing between adjacent terminals and the dimensions of the terminals must be decreased, thereby making the terminals more fragile. It is desirable, therefore, to configure the terminals and housing in a manner to meet the mechanical and environmental conditions and electrical performance requirements while providing a robust structure. It is further desirable to provide a structure that eliminates the need for external hardware to support the connector system, thus minimizing space needed on a board.

SUMMARY OF THE INVENTION

The present invention provides a highly dense and compact connector system that alleviates problems associated with the prior art. The system comprises first and second complementary connectors, each connector including a housing having a mating face, an assembly face and opposed side walls, and a plurality of terminal receiving passageways extending between the mating and assembly faces. The first connector has a plurality of first terminals, each disposed in a respective terminal receiving passageway. The second connector has a plurality of second terminals, each disposed in a respective terminal receiving passageway. Each terminal receiving passageway of the first connector includes a blade receiving slot extending from the mating face and through a portion of an adjacent side wall. Each first terminal has a first connecting portion aligned with the slot in the side wall and adapted to receive a blade contact therebetween upon being mated thereto. The second connector housing includes a shroud extending forwardly from the mating face defining a mating cavity dimensioned to receive a portion of the first connector therein upon mating the first and second connectors. Each second terminal has a first connecting portion defined by a blade extending into the shroud along side walls thereof, each blade including at least one portion that cooperates with a complementary portion of the shroud to assure that the blade is held in a desired position in the shroud, such that upon mating the first and second connectors, the first connector housing portion is received into the mating cavity and each blade is received into a corresponding blade receiving slot and is electrically engaged with the first connecting portion of the first connector terminal.

The invention is further directed to an electrical connector system including first and second complementary connectors, each connector having a housing with a mating face. The first connector has a plurality of first terminals, each disposed in a respective terminal receiving passageway and the second connector has a plurality of second terminals, each disposed in a respective terminal receiving passageway. The first connector housing includes at least one protrusion extending forwardly from the mating face adjacent at least a portion of the first terminals and dimensioned to be received in a corresponding protrusion receiving cavity extending into the mating face of the second connector housing adjacent corresponding second terminals, such that upon mating the first and second connectors, the cooperating protrusion extends into the cavity thereby increasing the length of the housing to housing interface between the mated connectors. By providing the housings of the first and second connectors with one or more protrusions and cooperating cavities, the protrusions and cavities also can be configured and dimensioned to provide polarization and keying features for the system.

Embodiments of the invention will now be described by way of example with reference to the accompanying drawings.

DETAILED DESCRIPTION OF EMBODIMENTS OF THE INVENTION

Figure 1:
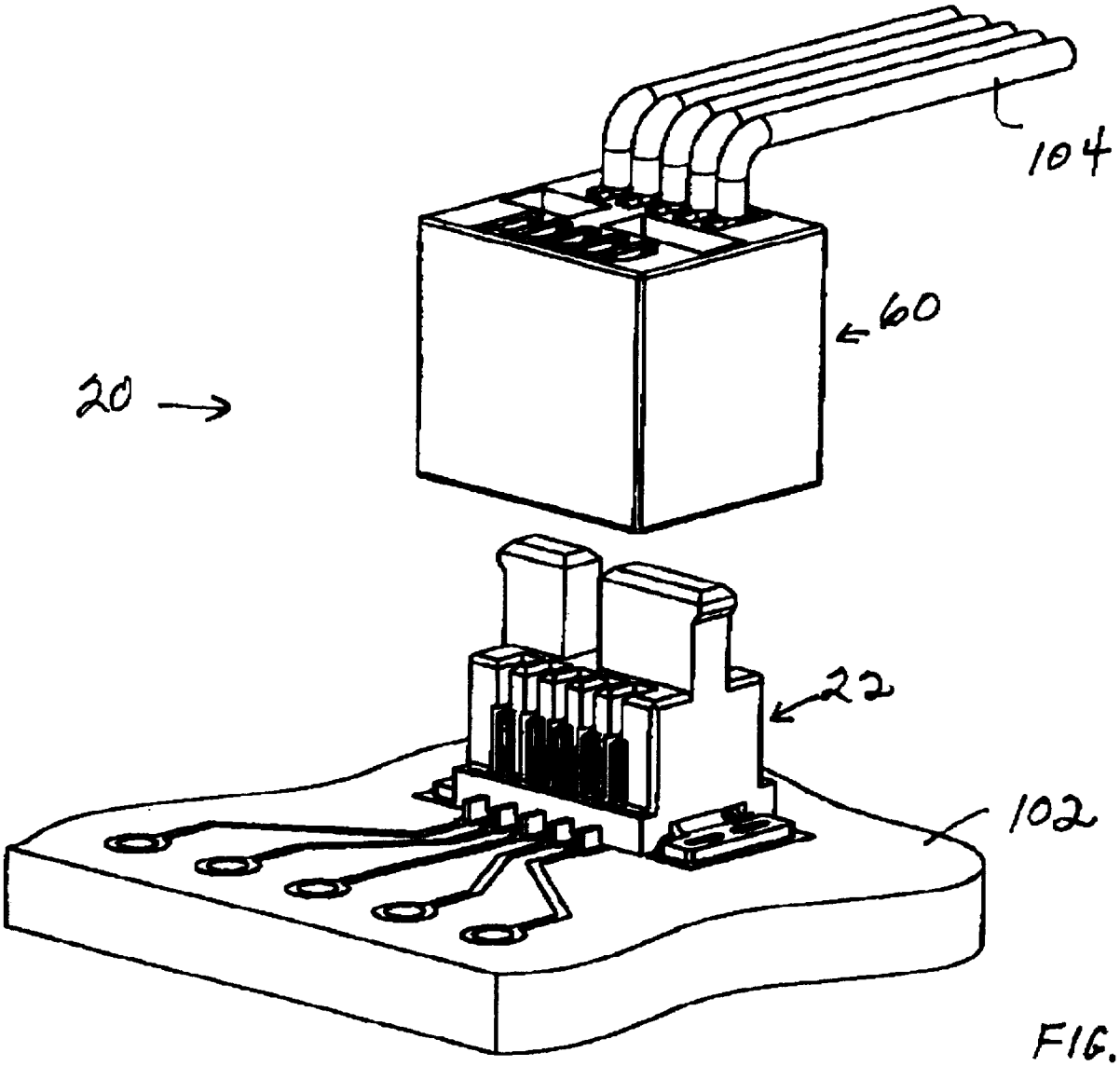
FIG. 1 is an isometric exploded view of a connector system including a board mountable connector and a cable connector made in accordance with the invention.
Figure 2:
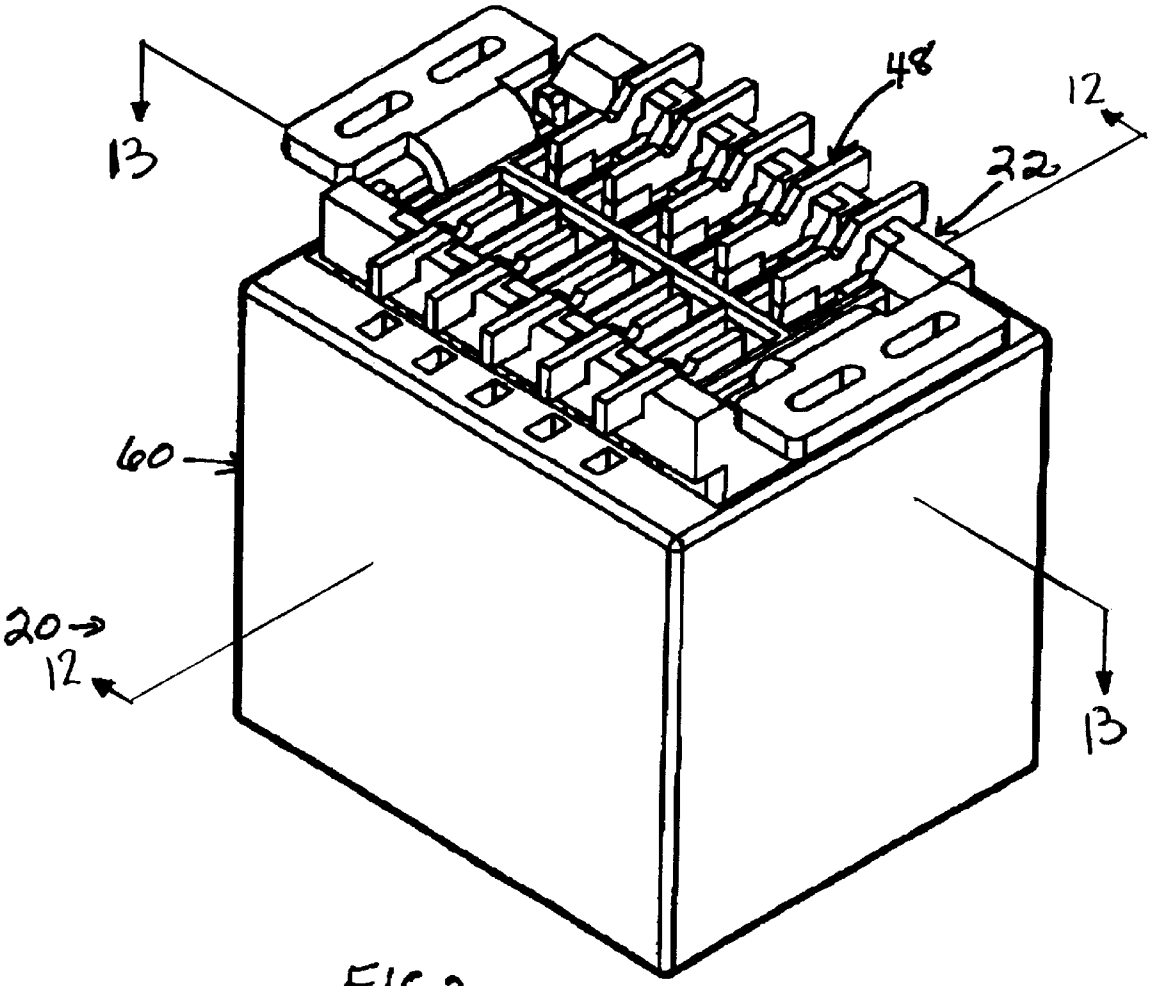
FIG. 2 is an isometric view of the mated connector system of FIG. 1.

Referring first to FIGS. 1 and 2, connector system 20 includes a first connector 22 mounted to circuit board 102 and a complementary second or cable connector 60 terminated to a plurality of conductors 104. For purposes of illustration, the connector system is shown as a ten position cable to board connector system. It is to be understood that the invention is not limited to the cable to board configuration, nor to ten positions.

Figure 3:
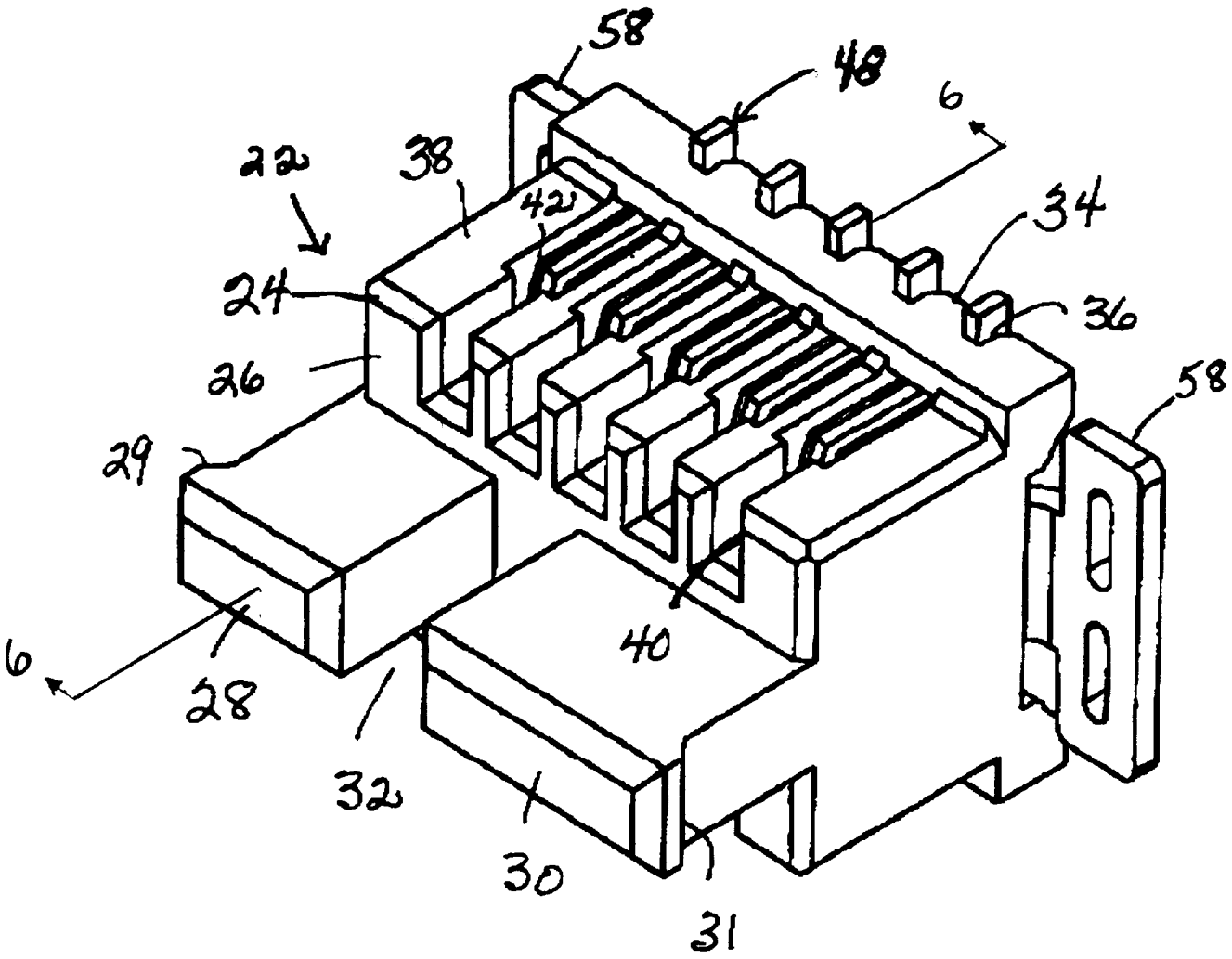
FIG. 3 is an isometric view of the board mountable connector of the system of FIG. 1.
Figure 4:
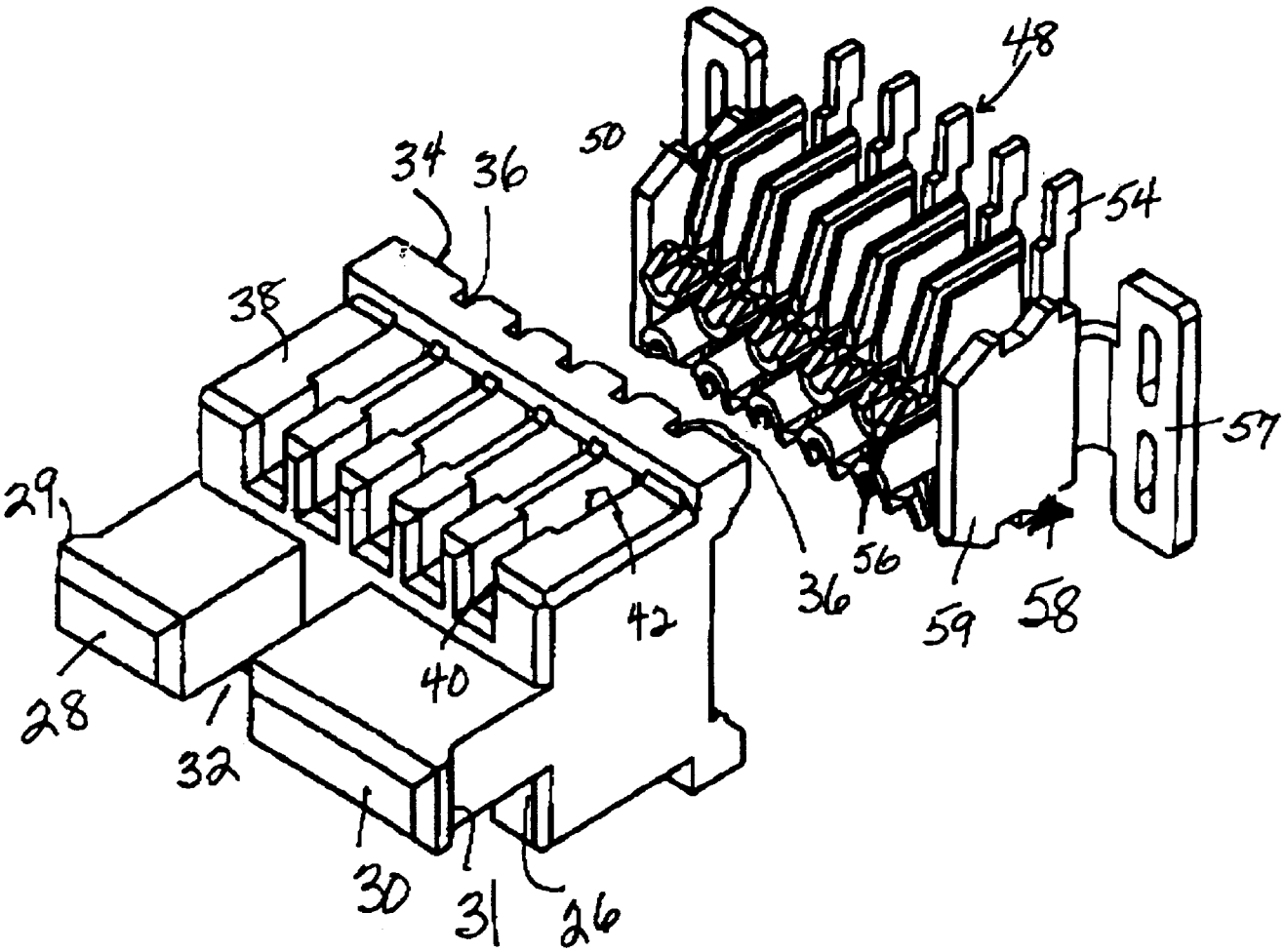
FIG. 4 is an isometric exploded view of the housing and terminals of the board mountable connector of FIG. 3.
Figure 5:
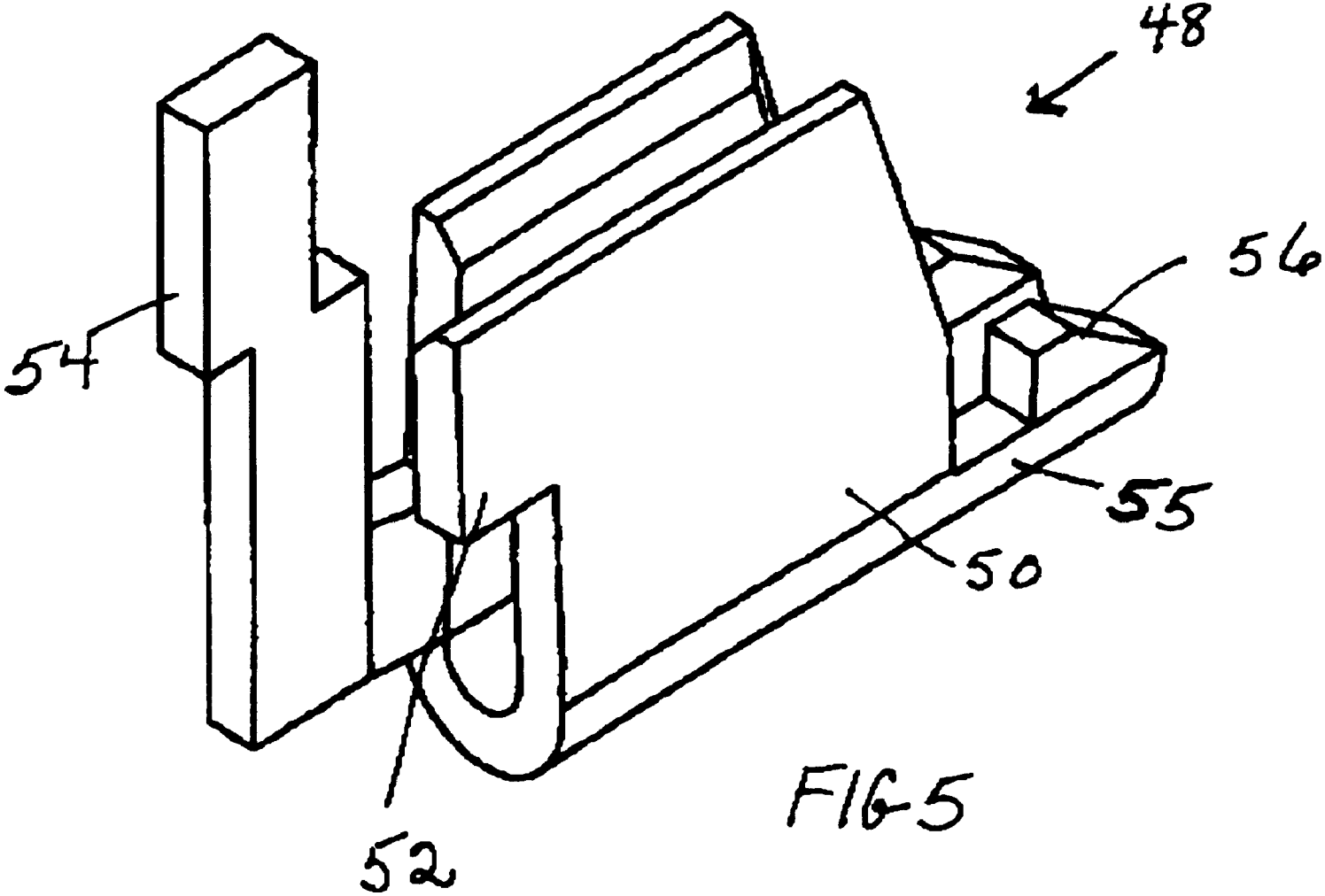
FIG. 5 is an isometric view of an exemplary terminal of the board mountable connector of FIG. 3.
Figure 6:
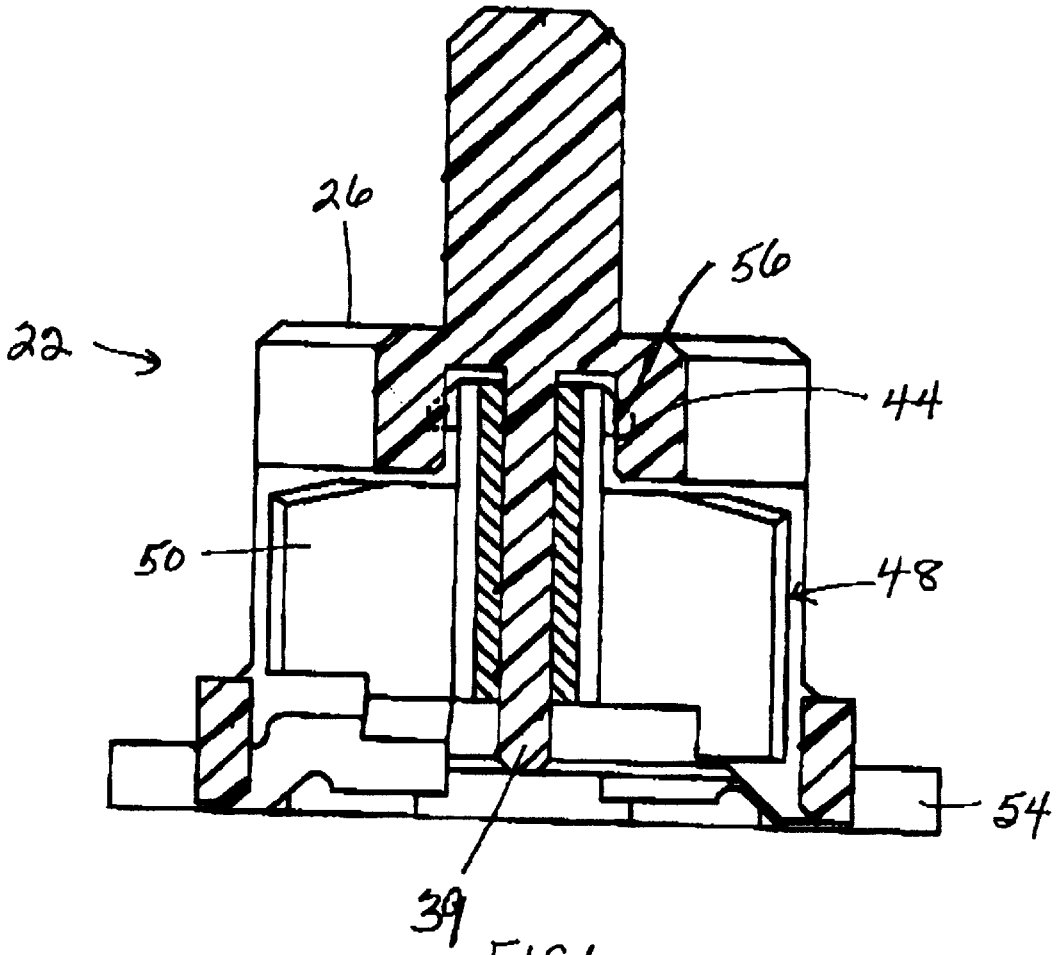
FIG. 6 is a cross-sectional view of the assembled board mountable connector of FIG. 3 taken along line 6—6.
Figure 7:
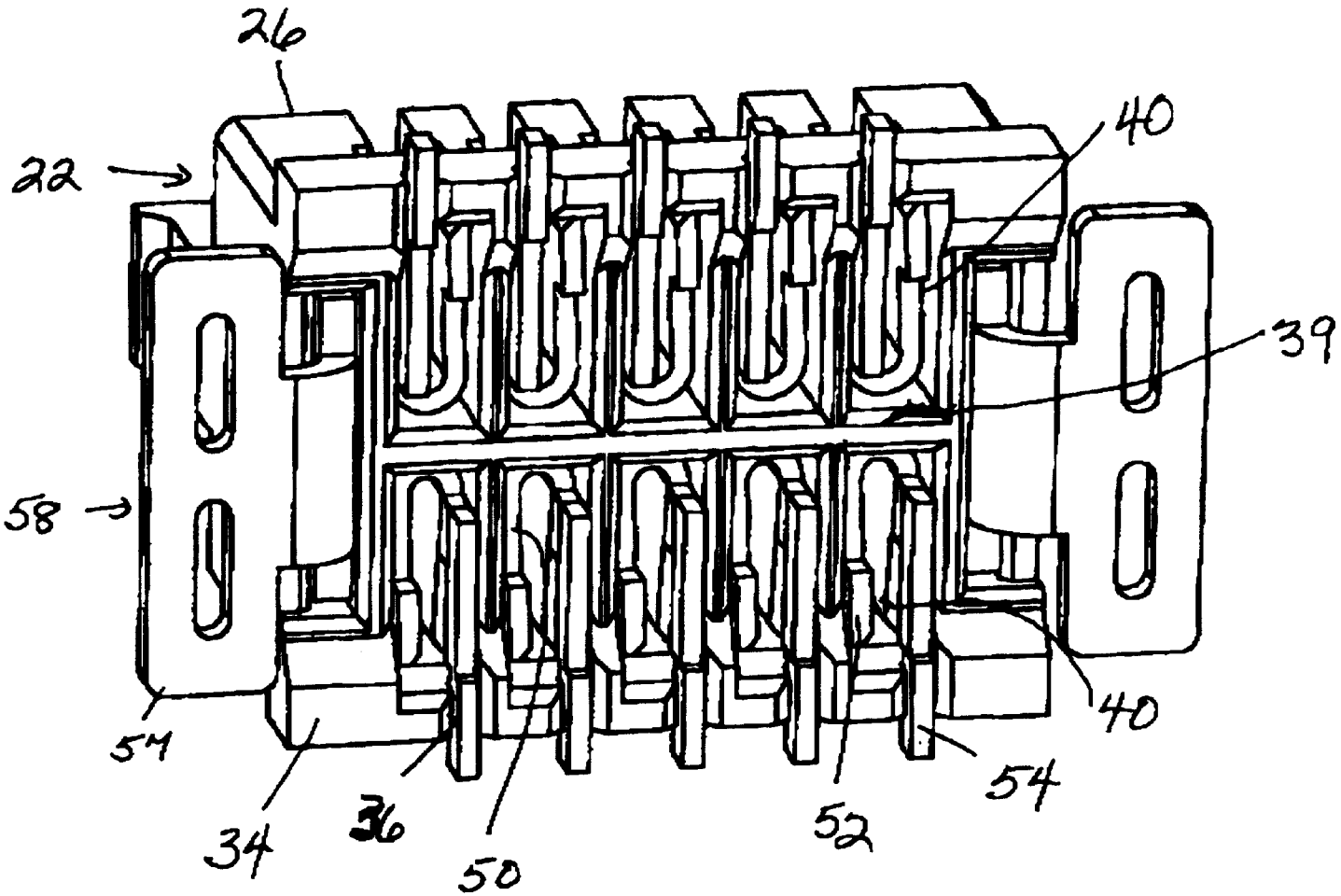
FIG. 7 is an isometric view of the board mountable connector of FIG. 3 as viewed from the board mounting face.
Figure 8:
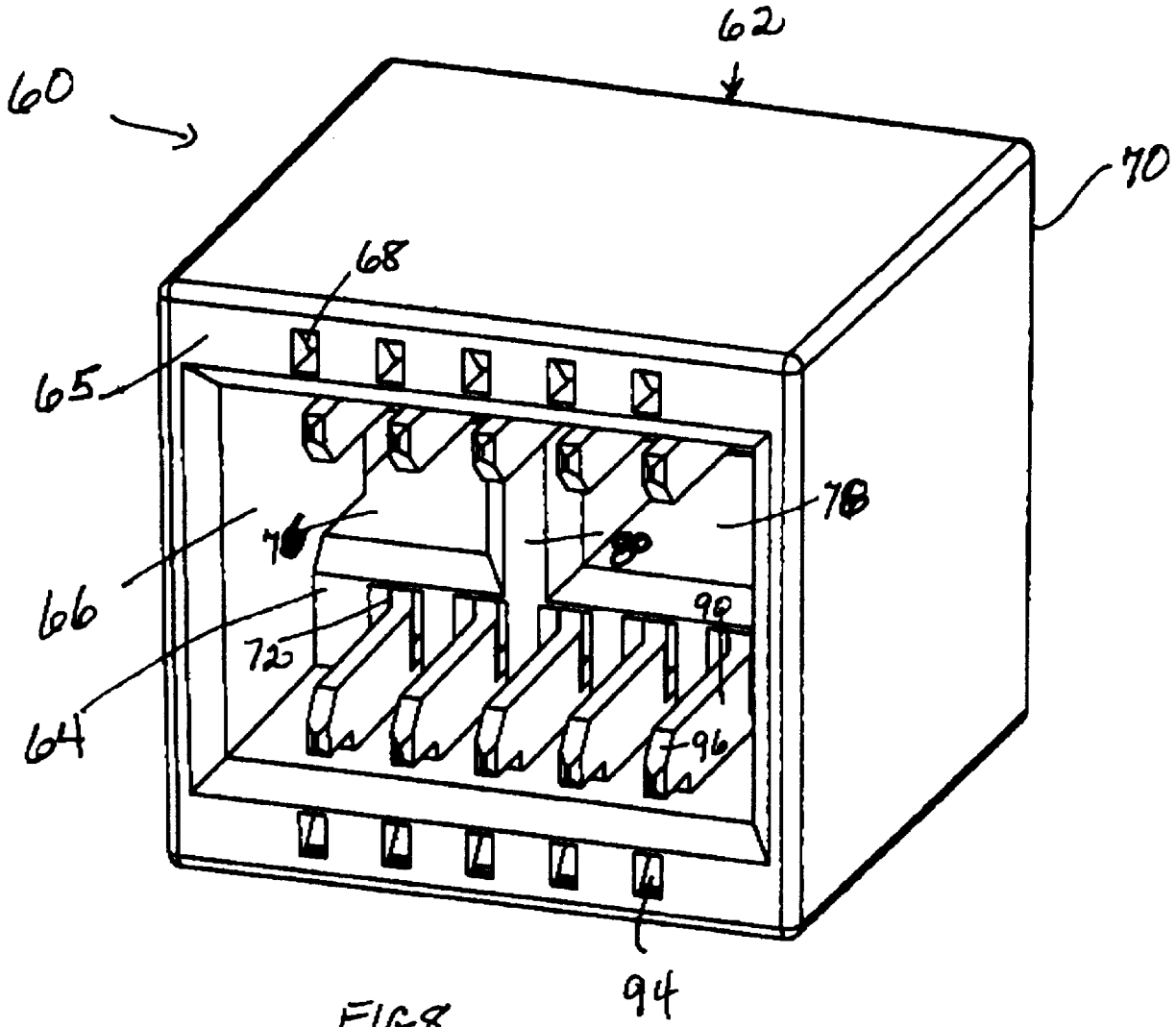
FIG. 8 is an isometric view of the cable connector of FIG. 1, as viewed from the mating face.
Figure 9:
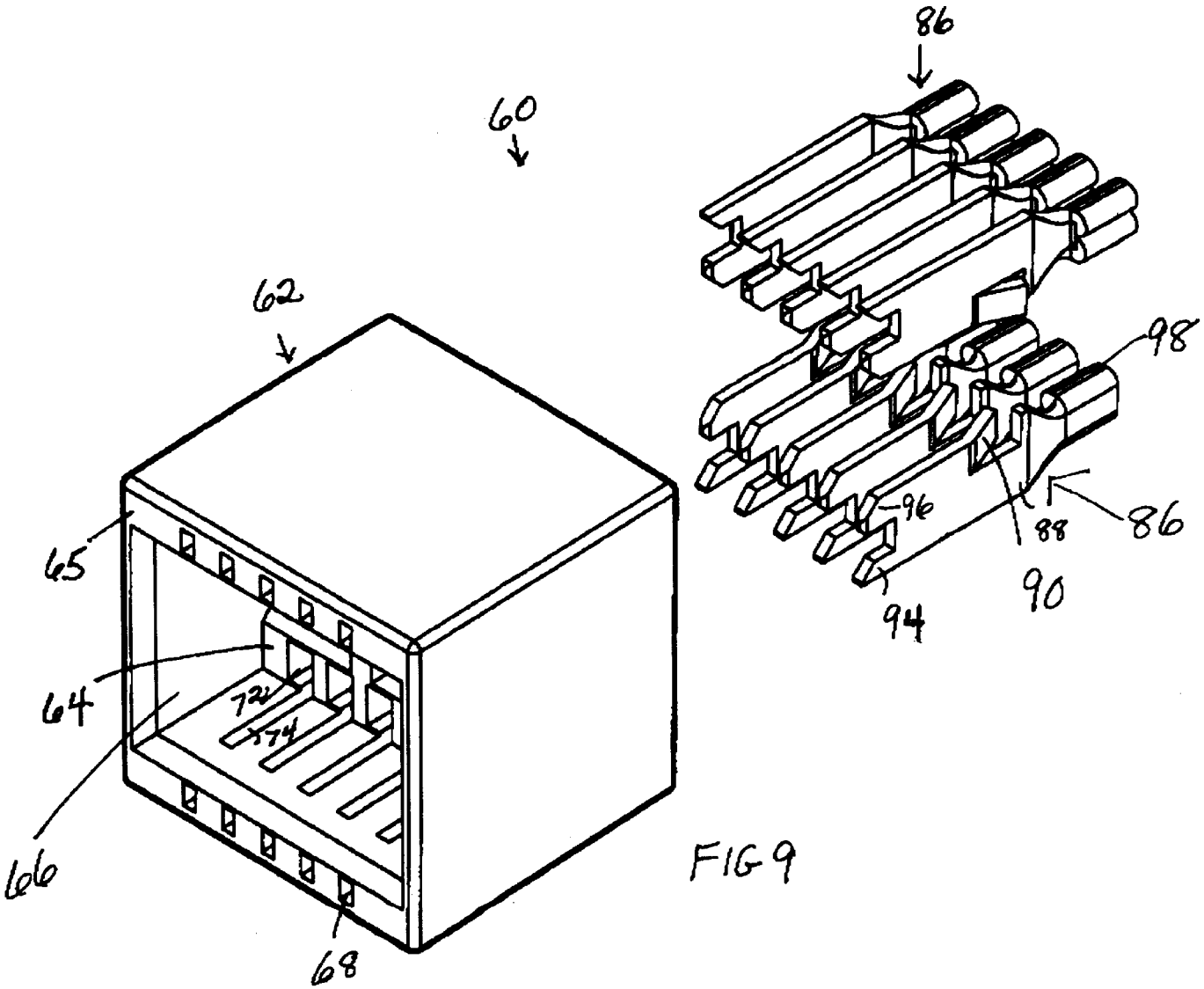
FIG. 9 is an isometric exploded view of the housing and terminals of the cable connector of FIG. 8.
Figure 10:
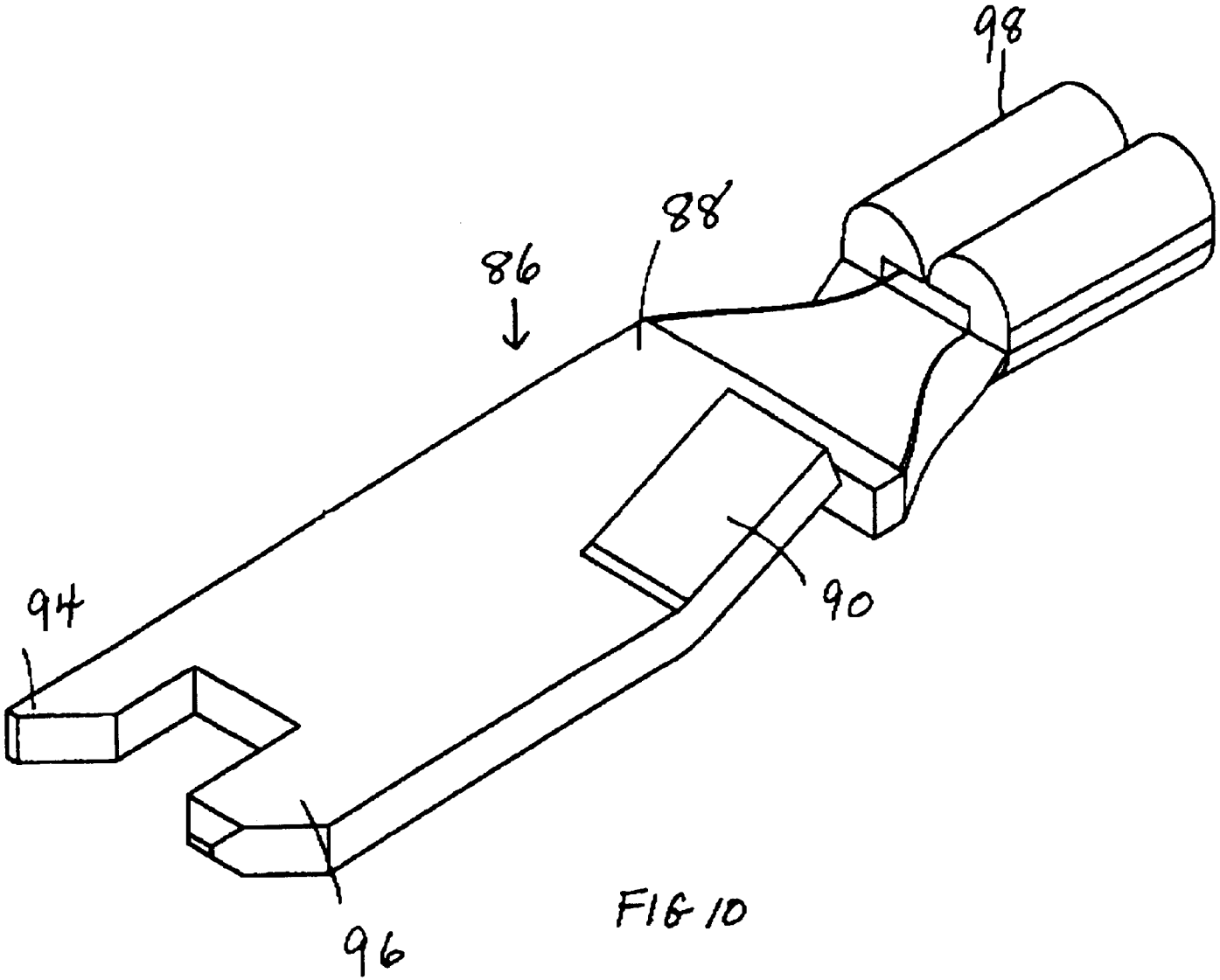
FIG. 10 is an isometric view of an exemplary terminal of the cable connector of FIG. 8.

FIGS. 3 through 7 illustrate the first or board mountable connector 22. Connector 22 includes housing 24, and a plurality of first terminals 48. As shown herein, connector 22 also includes an optional pair of board locks 58. It is to be understood that other board lock designs may be used or the board locks may be eliminated. Housing 24 includes a mating face 26, a board mounting or assembly face 34 and side walls 38 and a plurality of terminal receiving passageways 40 extending between the mating and board mounting faces 26, 34. Terminal receiving passageways 40 include slotted openings 42 defining blade receiving slots extending from the mating face 26 and partially along adjacent side walls 38. Board mounting or assembly face 34 includes a plurality of contact receiving slots 36, each slot 36 being in communication with a terminal receiving passageway 40 for receiving a connecting portion 54 of the associated terminal 48, as best seen in FIGS. 3 and 7. In the embodiment as shown, housing 24 further includes a pair of protrusions 28, 30 extending outwardly from the mating face 26 and having a space 32 therebetween. Protrusions 28 and 30 provide polarization and keying for connector 22, as more fully explained below. It is to be understood that the number of protrusions and slots therebetween can be varied depending upon the size of the connectors and the number of keying positions needed for a large array of connectors of the same size.

Terminals 48, as best seen in FIG. 5, include a U-shaped body portion 50 defining a first connecting portion of the terminal 48, a positioning protrusion 52, the second connecting portion or surface mountable leg 54 and a retention arm 55 having barbs 56 extending from the leading end of the base of the U. Upon inserting a terminal 48 in a respective terminal receiving passageway 40, the base of U-shaped body portion 50 is positioned against an inner wall 39 of the housing 24 with the open portion of the body portion 50 extending toward the blade receiving slot 42 in side wall 38. The second connecting portion 54 extends through a corresponding contact receiving slot 36 in board mounting or assembly face 34 thereby holding the connecting portion in position. The retention arm 55 and barbs 56 of terminal 48 extend into the upper portion of terminal receiving passageway 40 and are secured on cooperating ledges 44 within passageway 40, as best seen in FIG. 6. Positioning protrusion 52 extends to board mounting or assembly face 34 to stabilize the lower end of terminal 48. Thus, terminals 48 are secured at two locations, the leading end and the rearward end thus assuring the terminals are held in the desired location in the housing.

Figure 11:
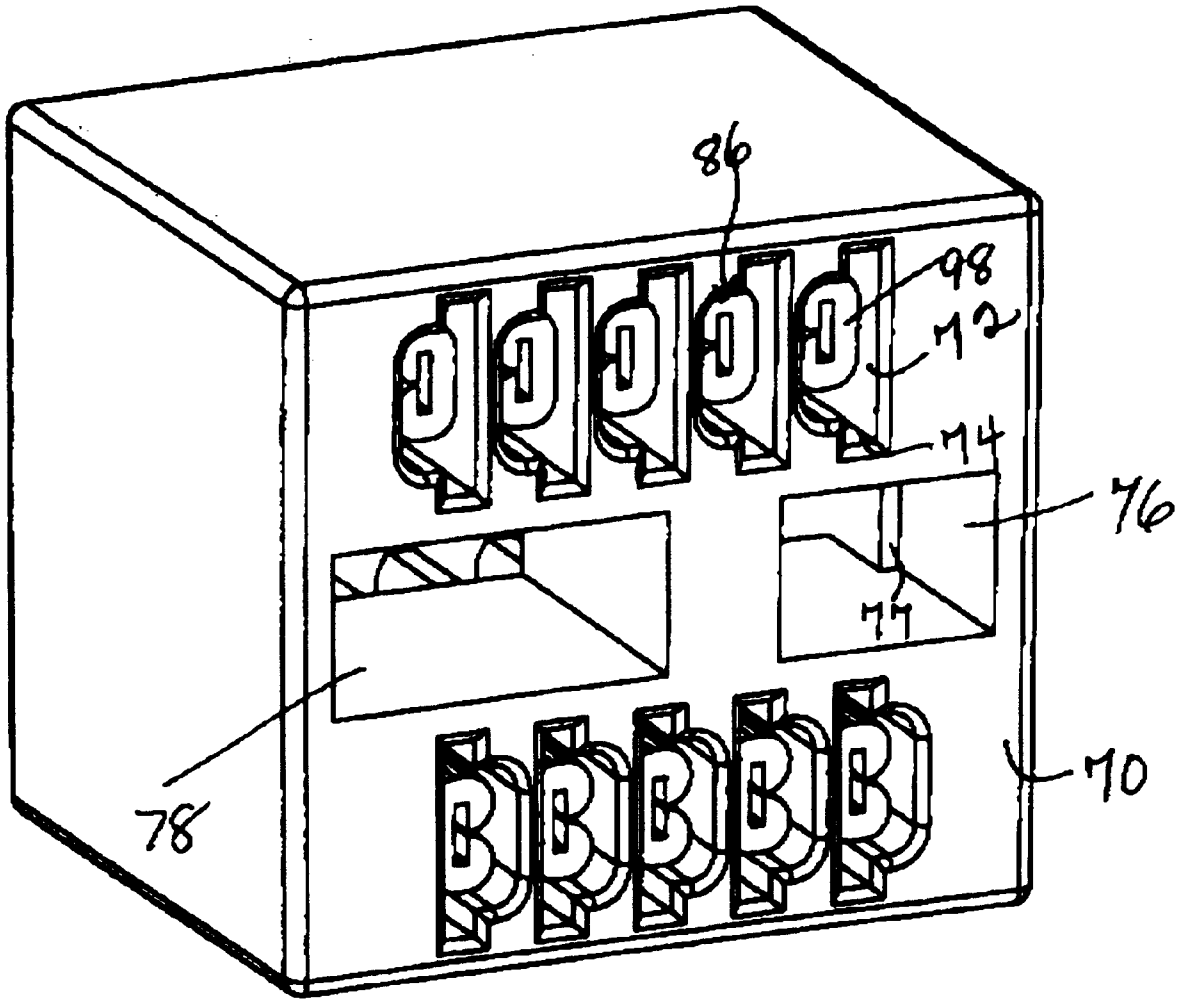
FIG. 11 is an isometric view of the cable connector of FIG. 8 as viewed from the assembly face.
Figure 13:
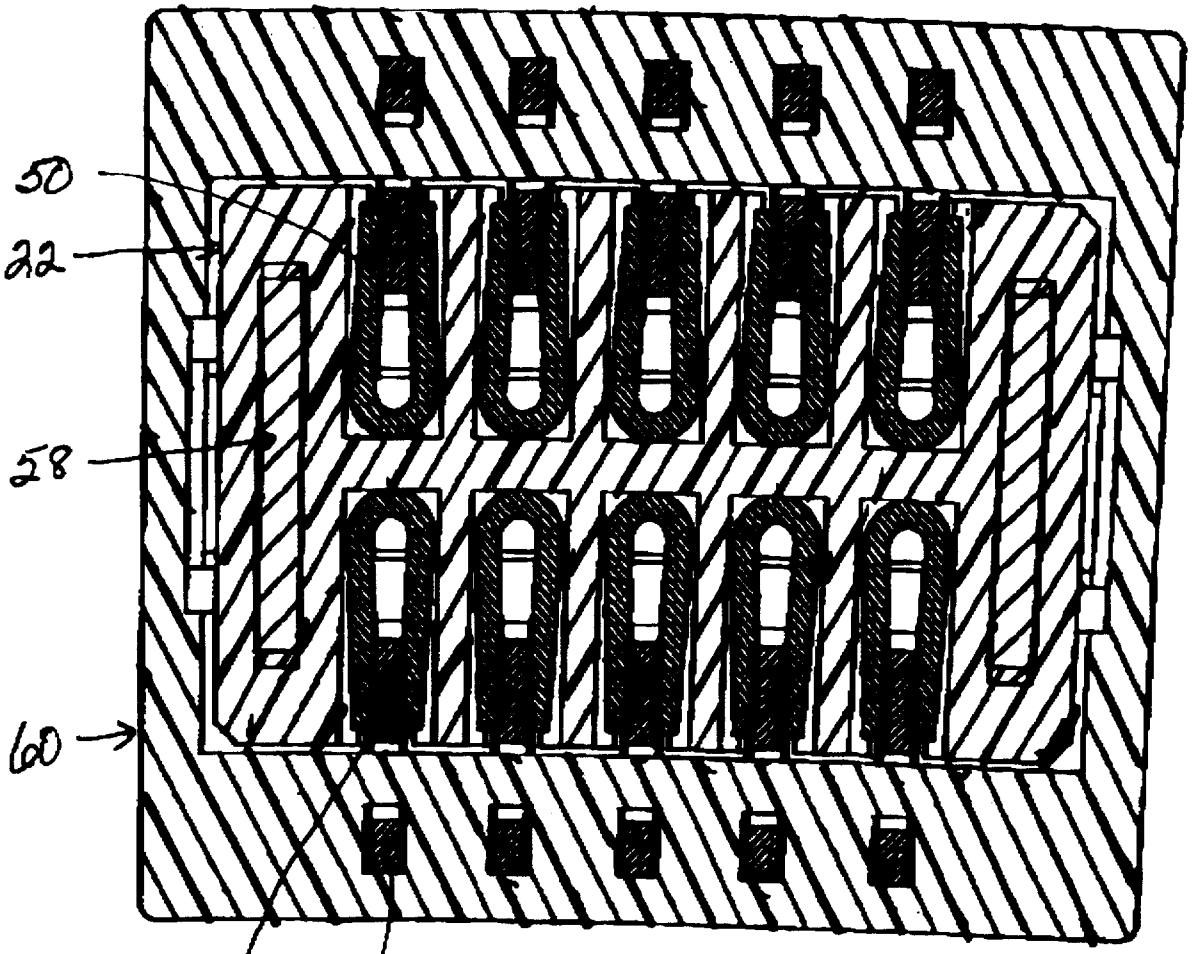
FIG. 13 is a sectional view of the mated system taken through the mated terminals along line 13—13 of FIG. 2.

FIGS. 8 through 11 illustrate the second or cable connector 60 of system 20. Connector 60 includes a housing 62 having a mating face 64 having a shroud 65 extending forwardly therefrom, an assembly or cable terminating face 70, a plurality of terminal receiving passageways 72 and a plurality of second or blade terminals 86. Shroud 65 defines a mating cavity 66 dimensioned to receive and surround board mountable connector 22, as best seen in FIGS. 2 and 13. Each terminal receiving passageway 72 includes a blade receiving slot 74 that extends from assembly face 70 through mating face 66 and along side walls of shroud 65 and ending at apertures 68 at the leading edge thereof. A pair of protrusion receiving cavities or passageways 76, 78 dimensioned to receive respective protrusions 28, 30 extend rearwardly from the base of the mating cavity to assembly face 70. Passageways 76, 78 are spaced by a wall or rib 80 dimensioned to be received in slot 32 of connector 22. FIG. 11 shows latching ledge 77 within passageway 76 that cooperates with retention surface 29 on protrusion 28 (shown in FIG. 3) to secure the connectors together. Passageway 78 includes a similar latching ledge (not shown) that cooperates with retention surface 31 on protrusion 30.

Figure 12:
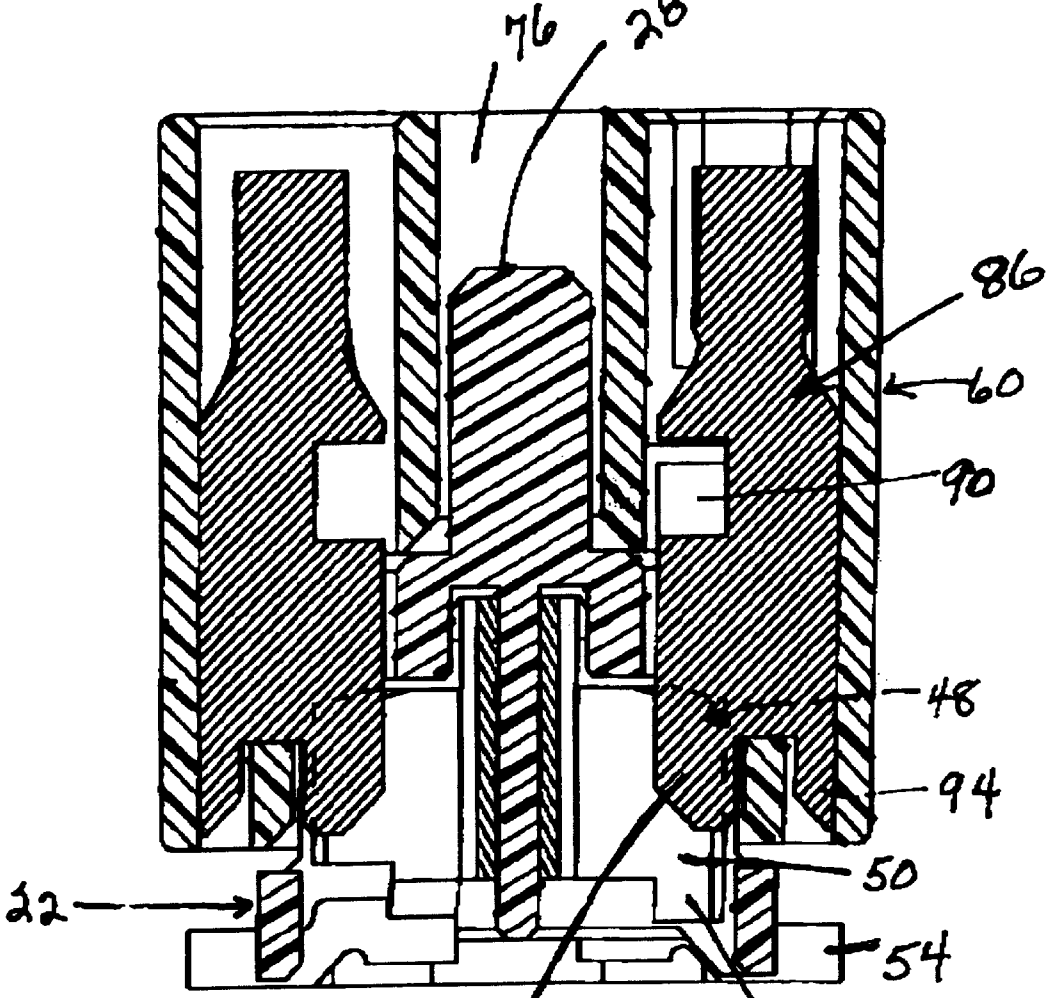
FIG. 12 is a cross-sectional view of the mated system taken along line 12—12 of FIG. 2.

Terminals 86 include a blade body portion 88 having a locking lance 90 therein, a first connecting blade portion 96 at one end of body portion 88 and a second connecting or cable terminating portion 98 at the opposite end of body portion 88. The blade terminal is a substantially rigid member that is more robust than a spring member or formed socket, as used in the prior art. Each blade is terminated by crimping to a wire 104, as shown in FIG. 1. In the embodiment as shown, the wire crimp lies substantially in the plane of the body of the blade, thus permitting the terminals 86 to be spaced close together and additionally allows the terminal to be crimped to larger diameter wires. The leading end of blade body 88 further includes a retention section 94 adapted to be received in slot 74 of terminal receiving passageway 72, extend through mating face 64 and along a side wall of shroud 65 spaced form the first connecting blade portion 96. Blade portion 96 is dimensioned to be received between the upstanding arms 50 of U-shaped terminal 48 upon the connectors being mated, as shown in FIGS. 12 and 13. First connecting blade portion 96 engages both of the arms 50 such that they are forced outwardly thereby assuring there are at least two points of contact between the terminals 48 and 86. The retention section 94 assures that the terminal 86 will be held in the desired position in the housing.

The housings for connectors 22 and 60 are molded from conventional materials in single action molds. The terminals are stamped from conventional materials, as known in the art. The present invention provides a connector that is highly dense and compact. For example, a ten position connector system having terminals on 0.8 mm centerlines has an exterior width of 6.25 mm, a depth of 5.2 mm and a height of 6.25 mm. A similar 20 position connector system has an exterior width of 10.25 mm, a depth of 5.2 mm and a height of 6.25 mm. If board locks, such as the ones illustrated in the Figures, are desired the width of the ten position connector would be increased to 7.35 mm and the width of the twenty position connector would be increased to 11.35 mm.

The U-shaped terminals are stamped and formed from conventional materials, such as phosphor bronze or the like, as known in the art and are 0.15 mm thick. The blade may be stamped from brass or the like, as known in the art, and are 0.2 mm thick. Connectors 22 and 60 are assembled by inserting the respective terminals 48, 86 into the corresponding terminal receiving passageways 40, 72 and retained in position as described above.

Upon mating connectors 22, 60, the protrusions 28, 30 of connector 22 enter passageways 76, 78 of connector 60 to align the connectors prior to engagement of blade contact portions 96 of terminals 86 between blade receiving arms 50 of terminals 48. The blade receiving slots 42 on the side walls 38 of the first or board mountable connector permit the first connecting blade portions 96 to enter the mating face and slide along and within the slot 42 until the first and second connectors 22, 60 are fully mated, as shown in FIG. 13. This allows the part of the first connector between adjacent slots of the housing to extend between adjacent blade terminals 86 resulting in a more compact system than would be achieved if the side walls were solid. Protrusions 28, 30 and cavities 76, 78 increase the length of the interface between the mating housings, thereby eliminating the need for external hardware, as used in the prior art, to stabilize the connectors to prevent rocking of a cable connector with respect to a board mounted connector. Furthermore if protrusions 28 and 30 have different dimensions, as shown herein, they also provide polarization for the connector system 20 to assure the mating connectors are correctly orientated as well as aligned. When a plurality of identically sized connectors are to be mounted to the same circuit board, the housings can be made with differently sized and spaced protrusions thus enabling the protrusions to provide a keying function.

Figure 14:
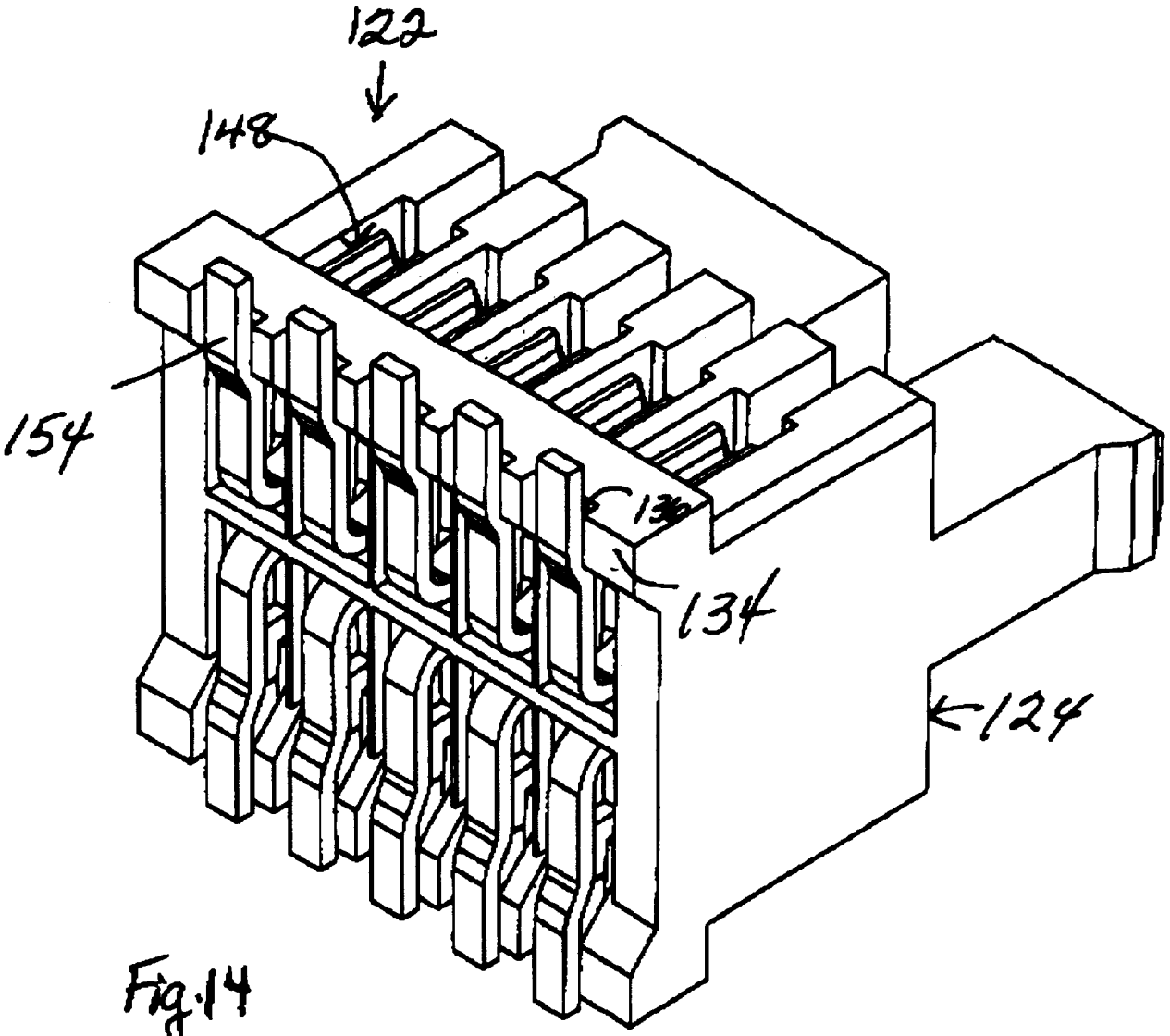
FIG. 14 is an isometric view of another embodiment of the board mountable connector.
Figure 15:
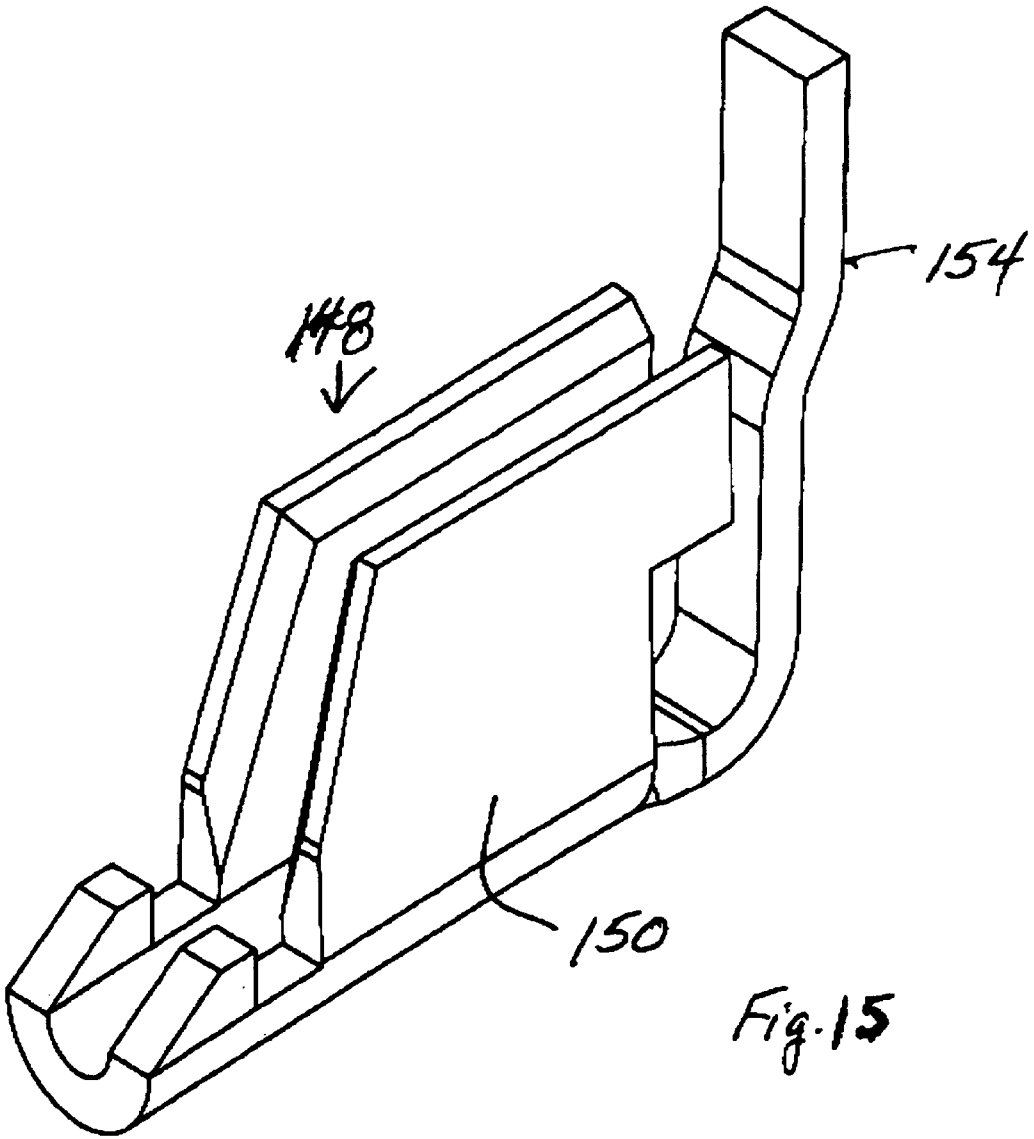
FIG. 15 is an isometric view of the alternative embodiment of the terminal in the connector of FIG. 14.

FIGS. 14 and 15 illustrate an alternative embodiment 122 of the board mountable connector that uses an alternative embodiment 148 of the U-shaped terminal. In this embodiment, the second connecting section 154 extends from the base of the U-shaped body 150 and is positioned in slots 136 along the assembly face 134 of housing 124, as shown in FIG. 13.

The present invention provides a compact high density connector system that has two points of contact between the mating terminals, resists rocking and has polarization and keying features within the envelope of the housing. It is to be understood that the terminals may be made in a variety of sizes and the housings proportional to the size of the terminals. The design of the terminals assures that there will be at least two points of electrical contact between the mating terminals. The terminals are held in place at both the leading ends and the rearward ends by the cooperating structure within the housing passageways. The elimination of the solid side walls for the first connector housing helps to reduce the size of the connector system. Additionally, the protrusions at the mating face of the one connector and the cavities in the other connector provide additional mating interface between the housings thus minimizing rocking of the cable connector with respect to the board connector and eliminating the need for external hardware to stabilize the connectors. Furthermore, if any rocking does occur, the blade can move within the U-shaped slot of the mating terminal without becoming disengaged.

It is thought that the high density electrical connector system of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An electrical connector system comprising:

first and second complementary connectors, each connector including a housing having a mating face, an assembly face and opposed side walls, and a plurality of terminal receiving passageways extending between the mating and assembly faces, the first connector having a plurality of first terminals, each disposed in a respective terminal receiving passageway, and the second connector having a plurality of second terminals, each disposed in a respective terminal receiving passageway;

each terminal receiving passageway of the first connector including a blade receiving slot extending from the mating face and through a portion of an adjacent side wall;

each first terminal having a first connecting portion aligned with the slot in the side wall and adapted to electrically engage a blade contact upon the connectors being mated;

the second connector housing further including a shroud extending forwardly from the mating face defining a mating cavity dimensioned to receive a portion of the first connector therein upon mating the first and second connectors;

each second terminal having a first connecting portion defined by a blade extending into the shroud along side walls thereof, each blade including at least one portion that cooperates with a complementary portion of the shroud to assure that the blade is held in a desired position in the shroud, such that upon mating the first and second connectors the first connector housing portion is received into the mating cavity and each blade is received into a corresponding blade receiving slot of the first connector and is electrically engaged with the first connecting portion of the first terminal.

2. The electrical connector system of claim 1 wherein the first connecting portion of the first terminal is a U-shaped member.

3. The electrical connector system of claim 2 wherein each leg of the U-shaped member is electrically engaged to the blade.

4. The electrical connector system of claim 1 wherein the first terminal includes a retention arm extending forwardly from the first connecting portion and toward the mating face of the first connector, the retention arm having outwardly latch surfaces thereon that engage cooperating latch surfaces in the corresponding terminal receiving passageway, thereby retaining the first connector terminal in the housing.

5. The electrical connector system of claim 4 wherein the first terminal includes a second connecting portion extending through a slot in the assembly face, thereby holding the second connecting portion in the desired location in the housing.

6. The electrical connector system of claim 1 wherein each terminal receiving passageway of the second connector includes a blade receiving slot that extends from the assembly face, through the mating face and along the side wall of the shroud, the slot being dimensioned to receive an edge of the blade thereby assuring the blade is held in position in the housing.

7. The electrical connector system of claim 1 wherein the leading end of the blade includes a retention section that is received in an aperture on the leading edge of the shroud thereby assuring the blade is held in position in the housing.

8. The electrical connector system of claim 7 wherein the second terminal includes a locking lance proximate a second connecting section that secures the rearward portion of the terminal in the housing.

9. The electrical connector system of claim 1 wherein the second terminal includes a second connecting portion defined by a wire crimp that extends substantially in the plane of the blade.

10. The electrical connector system of claim 1 wherein the first connector housing further includes at least one protrusion extending outwardly from the mating face adjacent at least a portion of the first connector terminals, the protrusion being dimensioned to be received in a corresponding protrusion receiving cavity extending into the mating face of the second connector housing adjacent corresponding second terminals.

11. The electrical connector system of claim 10 wherein the at least one protrusion includes a retention surface that cooperates with a latching ledge within the cavity to secure the connectors together.

12. An electrical connector system comprising:

first and second complementary connectors, each connector including a housing having a mating face, the first connector including a plurality of first terminals, each disposed in a respective terminal receiving passageway and the second connector including a plurality of second terminals, each disposed in a respective terminal receiving passageway;

the first connector housing further including at least one protrusion extending outwardly from the mating face adjacent at least a portion of the first terminals and dimensioned to be received in a corresponding protrusion receiving cavity extending into the mating face of the second connector housing adjacent corresponding second terminals;

whereby upon mating the first and second connectors, the cooperating at least one protrusion extends into the cavity thereby increasing the length of the housing to housing interface between the mated connectors.

13. The electrical connector system of claim 12 wherein the at least one protrusion provides polarization for the connector system.

14. The electrical connector system of claim 12 wherein the at least one protrusion includes a retention surface that engages a cooperating latching ledge within the protrusion receiving cavity to secure the first and second connectors together.

15. The electrical connector system of claim 12 wherein the first connector housing includes at least two protrusions and the second connector housing includes at least two protrusion receiving cavities.

16. The electrical connector system of claim 15 wherein at least two protrusions include a retention surface that engages a cooperating latching ledge within the corresponding protrusion receiving cavity to secure the first and second connectors together.

17. The electrical connector system of claim 15 wherein the protrusions are configured to provide polarization for the connector system.

18. The electrical connector system of claim 17 wherein the protrusions are configured to provide keying for the connector system.

19. The electrical connector system of claim 15 wherein the protrusions are configured to provide keying for the connector system.

20. The electrical connector system of claim 1 wherein the first connector housing includes at least two rows of first terminals and the at least one protrusion extends from the mating face between the at least two rows of first terminals.

21. An electrical connector system comprising:

first and second complementary connectors, each connector including a housing having a mating face, an assembly face and opposed side walls, and a plurality of terminal receiving passageways extending between the mating and assembly faces;

each terminal receiving passageway of the first connector including a blade receiving slot extending from the mating face and through a portion of an adjacent side wall and along an exterior surface of the wall;

the second connector housing further including a shroud extending forwardly from the mating face defining a mating cavity dimensioned to receive a portion of the first connector therein upon mating the first and second connectors;

internal side walls of the shroud include a plurality of terminal receiving slots, each extending from the mating face to a leading end of the shroud, each being in communication with a respective terminal receiving passageway of the second connector, such that upon mating of the first and second connectors, the first connector portion is received in the shroud such that the terminal receiving slots along the internal side walls of the shroud are aligned with the blade receiving slots along the external side walls of the first housing, the aligned slots together defining a terminal mating cavity, and portions of the first connector housing between adjacent blade receiving slots are received between adjacent slots of the shroud, thereby facilitating miniaturization of the connector system.

22. The electrical connector system of claim 21 wherein each terminal receiving passageway of the first connector includes a first terminal having a first connecting portion aligned with the blade receiving slot in the side wall and adapted to electrically engage a blade contact upon the first and second connectors being mated.

23. The electrical connector system of claim 22 wherein the first connecting portion of the first terminal is a U-shaped member.

24. The electrical connector system of claim 21 wherein each terminal receiving passageway of the second connector includes a second terminal having a first connecting blade portion that extends along the terminal receiving slot of the shroud and is received in the blade receiving slot of the first connector upon mating of the first and second connectors.

* * * * *